US005711040A

United States Patent [19]

Huang

[11] Patent Number: 5,711,040

[45] Date of Patent: Jan. 27, 1998

[54] FOLDING COLLAPSIBLE FRAME STRUCTURE FOR A BABY'S CRIB

[76] Inventor: Mien Chen Huang, 123-2, Pi Tou, Kuan Miao, Tainan, Taiwan

[21] Appl. No.: 816,244

[22] Filed: Mar. 13, 1997

[51] Int. Cl.[6] ..... A47D 13/06; A47D 7/00

[52] U.S. Cl. ..... 5/99.1; 5/98.1

[58] Field of Search ..... 5/99.1, 98.1, 93.1

[56] References Cited

U.S. PATENT DOCUMENTS 5,542,134 8/1996 Wang ..... 5/99.1

5,544,372 8/1996 Garland et al. ..... 5/99.1

*Primary Examiner*—Alexander Grosz

*Attorney, Agent, or Firm*—Pro-Techtor International

[57] ABSTRACT

A folding collapsible frame structure for a baby's crib, including two side frame units, two folding top frame rods and two folding bottom frame rods bilaterally connected between the side frame units at different elevations, a pair stretchers connected between the folding bottom frame rods in the middle, and a folding bed plate supported on the stretchers and having loops sleeved onto the stretchers, top joints and bottom joints respectively connected between the side frame units and the folding top and bottom frame rods which permit opposite ends of the folding top and bottom frame rods to be turned relative to the side frame units within 90° angle so that the frame structure is collapsed when the top frame rods are pushed downwards and folded up and the loops of the folding bed plate are pulled upwards.

7 Claims, 13 Drawing Sheets

FOLDING COLLAPSIBLE FRAME STRUCTURE FOR A BABY'S CRIB

BACKGROUND OF THE INVENTION

The present invention relates to baby's cribs, and more particularly to a folding collapsible frame structure for a baby's crib which can be conveniently folded up and secured firmly in the collapsed condition.

Regular baby's cribs are commonly not collapsible, therefore they occupy much storage space when not in use. In order to eliminate this problem, folding frame structures for baby's cribs have been disclosed. However, these folding frame structures are commonly complicated, and inconvenient to operate.

SUMMARY OF THE INVENTION

It is one object of the present invention to provide a folding collapsible frame structure for a baby's crib which can be conveniently folded up. It is another object of the present invention to provide a folding collapsible frame structure for a baby's crib which can be firmly secured in the collapsed condition when folded up. According to one aspect of the present invention, the folding collapsible frame structure comprises two side frame units, two folding top frame rods and two folding bottom frame rods bilaterally connected between the side frame units at different elevations, a pair stretchers connected between the folding bottom frame rods in the middle, and a folding bed plate supported on the stretchers and having loops sleeved onto the stretchers, top joints and bottom joints respectively connected between the side frame units and the folding top and bottom frame rods which permit opposite ends of the folding top and bottom frame rods to be turned relative to the side frame units within 90° angle so that the frame structure is collapsed when the top frame rods are pushed downwards and folded up and the loops of the folding bed plate are pulled upwards. According to another aspect of the present invention, a locating pin and a swivel hook are respectively mounted on the side frame units in the middle at the bottom, so that the folding collapsible frame structure can be firmly retained in the collapsed condition by hooking the swivel hook on the locating pin when the top and bottom frame rods are respectively folded up.

DETAILED DESCRIPTION OF THE PREFERRED EMBODIMENT

Figure 1:
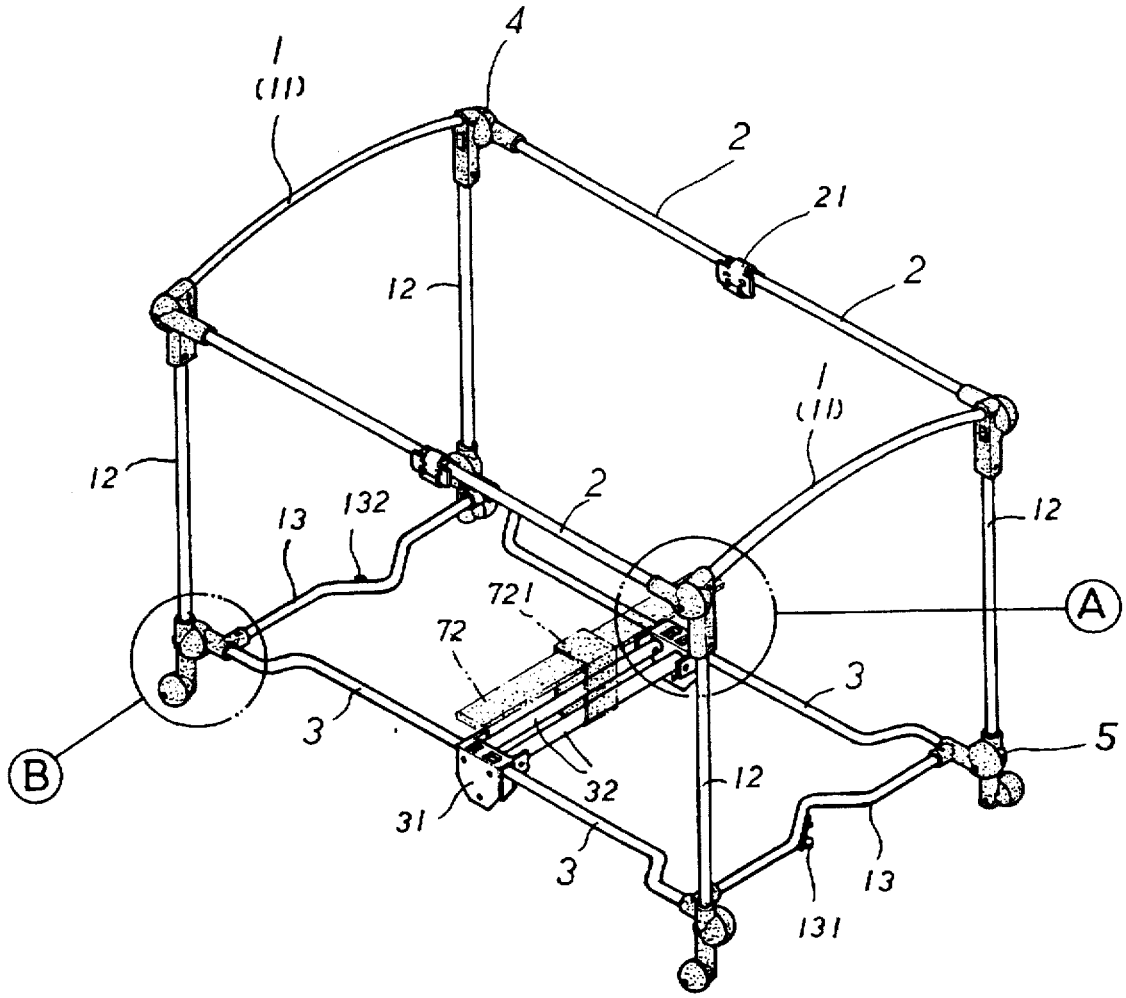
FIG. 1 is an elevational view of a folding frame structure for a baby's crib according to the present invention.
Figure 2:
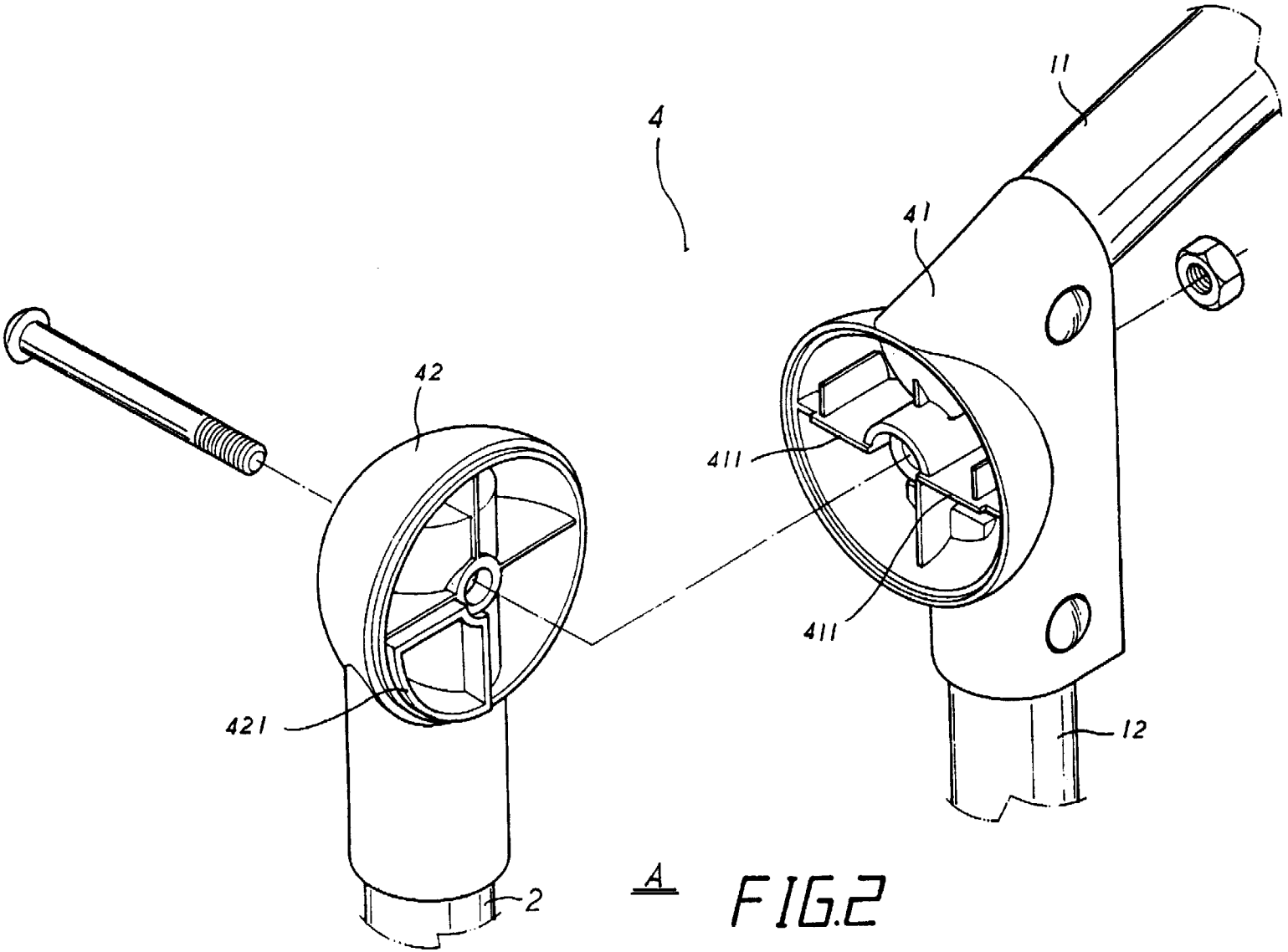
FIG. 2 is a perspective exploded view in an enlarged scale of part A (the second joint) of FIG. 1.
Figure 10:
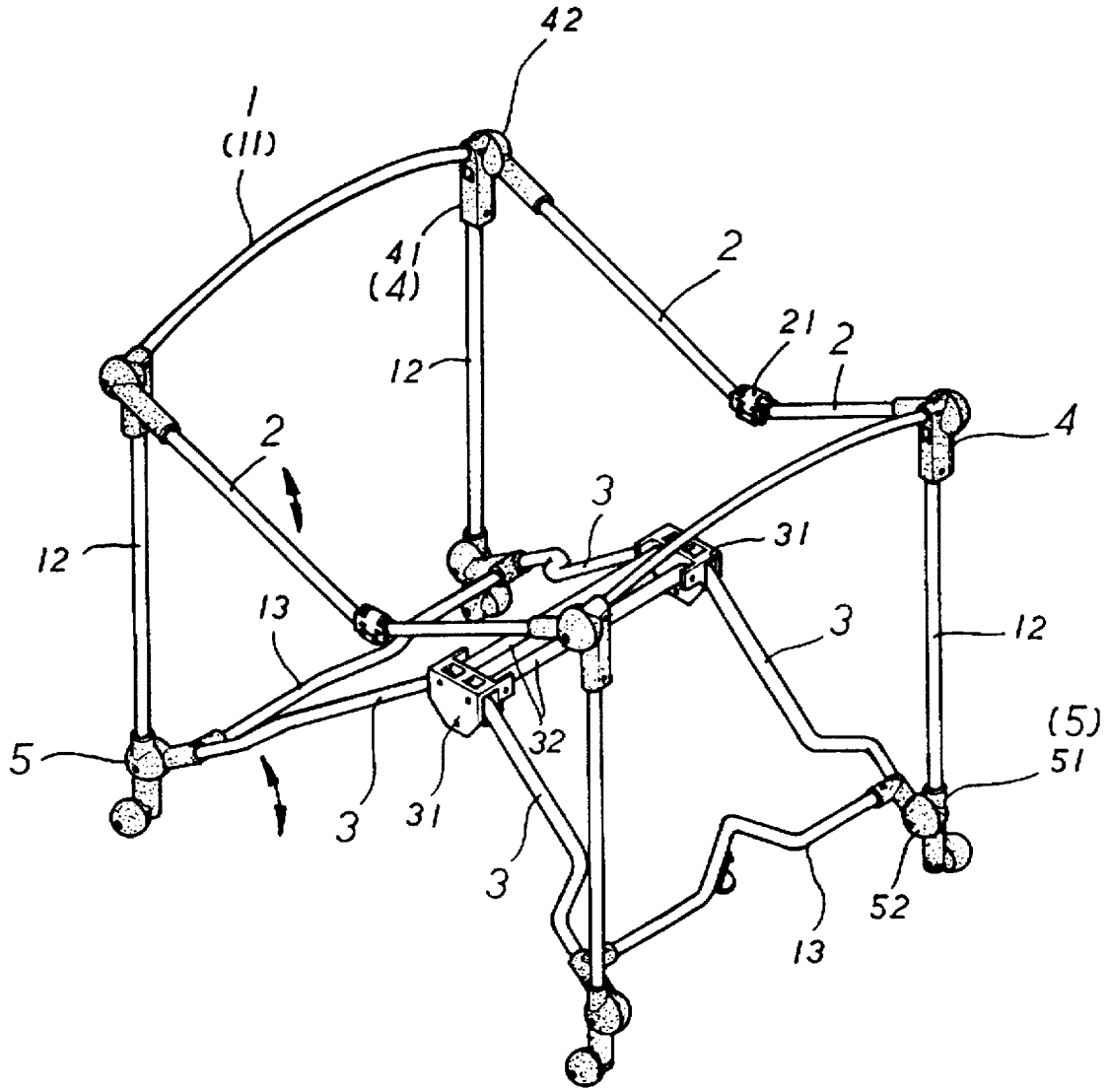
FIG. 10 shows the top frame rods and the bottom frame rods respectively folded up according to the present invention.

Referring to FIG. 1 and 10, a folding collapsible frame structure for a baby's crib in accordance with the present invention is generally comprised of two symmetrical side frame units 1, a pair of top frame rods 2 horizontally and bilaterally connected between the side frame units 1 at the top, and a pair of bottom frame rods 3 horizontally and bilaterally connected between the side frame units 1 at the bottom. Each of the side frame units 1 is comprised of a top transverse rod 11, a bottom transverse rod 13, and two posts 12 bilaterally connected between the top transverse rod 11 and the bottom transverse rod 13. Each of the top frame rods 2 is comprised of two sections pivoted together by a first joint 21. The first joint 21, as disclosed in U.S. Pat. app. Ser. No. 08/710,918, filed Sep. 24, 1996, permits the respective top frame rod 2 to be folded up when it is pushed downwards (see FIG. 10). Each of the bottom frame rods 3 is comprised of two sections pivoted together by a coupling plate 31. The coupling plate 31 serves also as a foot means for supporting the folding collapsible frame structure on the floor. When the coupling plate 31 is pushed upwards, the respective bottom frame rod 3 is folded up (see FIG. 10). The two opposite ends of the top transverse rod 11 of each side frame unit 1 and the top ends of the two posts 12 of the same side frame unit 1 are respectively connected to the top frame rods 2 by a respective second joint 4. The two opposite ends of the bottom transverse rod 13 of each side frame unit 1 and the bottom ends of the two posts 12 of the same side frame unit 1 are respectively connected to the top frame rods 2 by a respective third joint 5.

Figure 5:
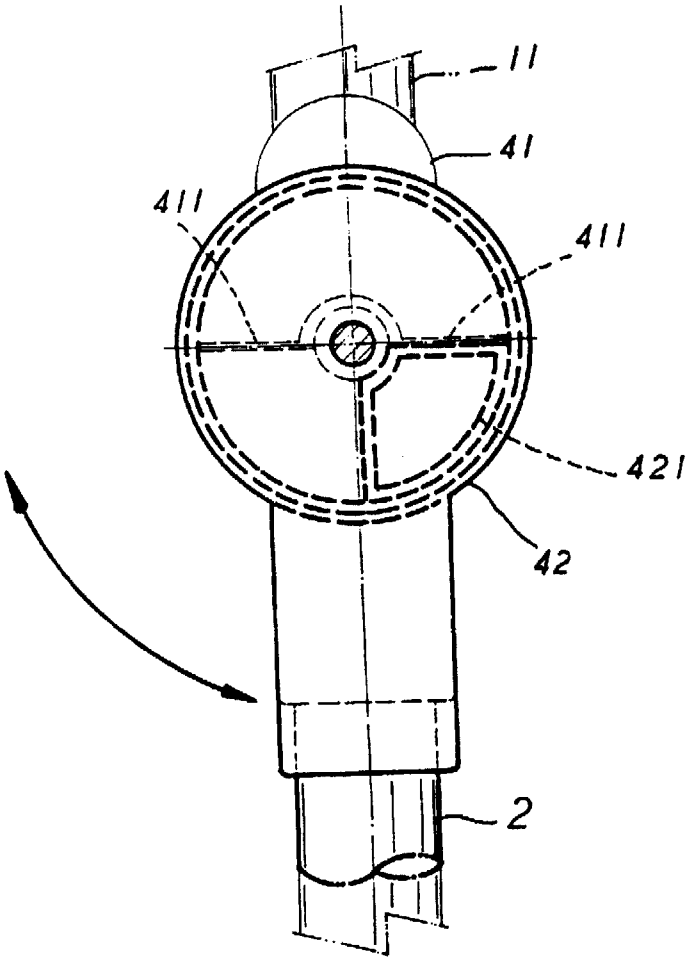
FIG. 5 is similar to FIG. 4 but showing the top frame rod turned from the operative position to the collapsed position.
Figure 4:
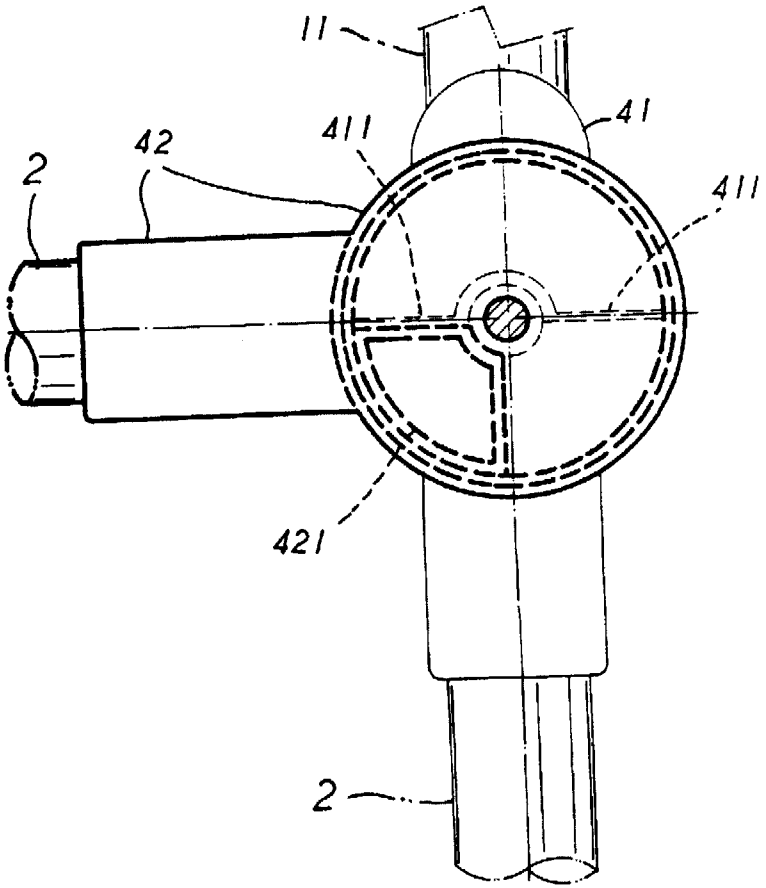
FIG. 4 is another sectional assembly view of FIG. 2 taken from another angle, showing the top frame rod turned from the collapsed position to the operative position.

Referring to FIGS. from 2 to 4, the second joint 4 is comprised of a hollow base frame 41 fixedly connected between one top transverse rod 11 and one post 12, and a hollow swivel frame 42 fixedly connected to one top frame rod 2 and coupled to the base frame 41 and turned about an axis. The swivel frame 42 comprises a 90° sector flange 421 at an inner side inserted into the base frame 41. The base frame 41 has a horizontal stop flange 411 on the inside adapted to match with the 90° sector flange 421 of the swivel frame 42, so as to limit the turning angle of the swivel frame 42 within 90° angle relative to the base frame 41 (see FIGS. 4 and 5).

Figure 6:
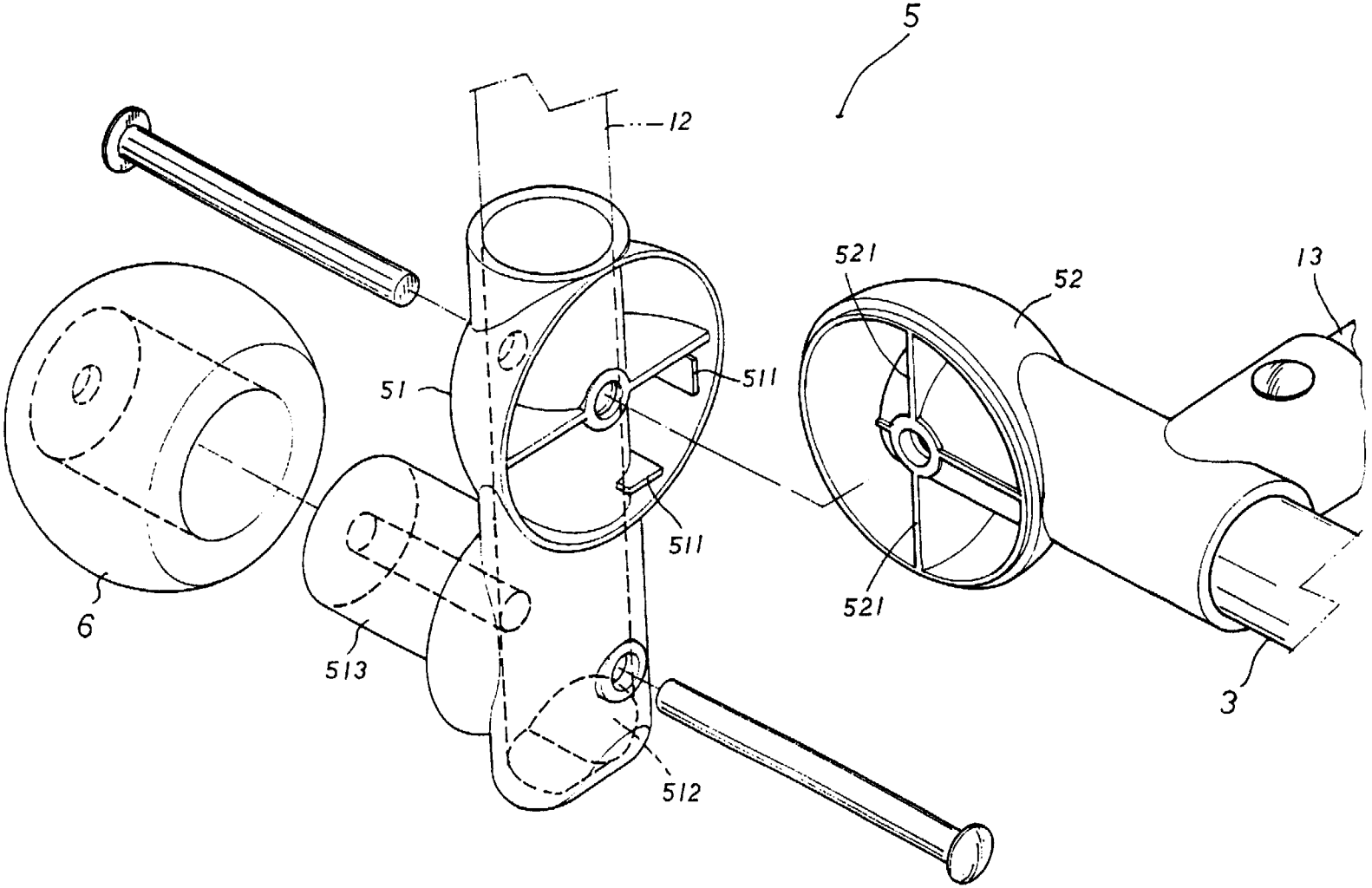
FIG. 6 is a perspective exploded view in an enlarged scale of part B (the third joint) of FIG. 1.
Figure 7:
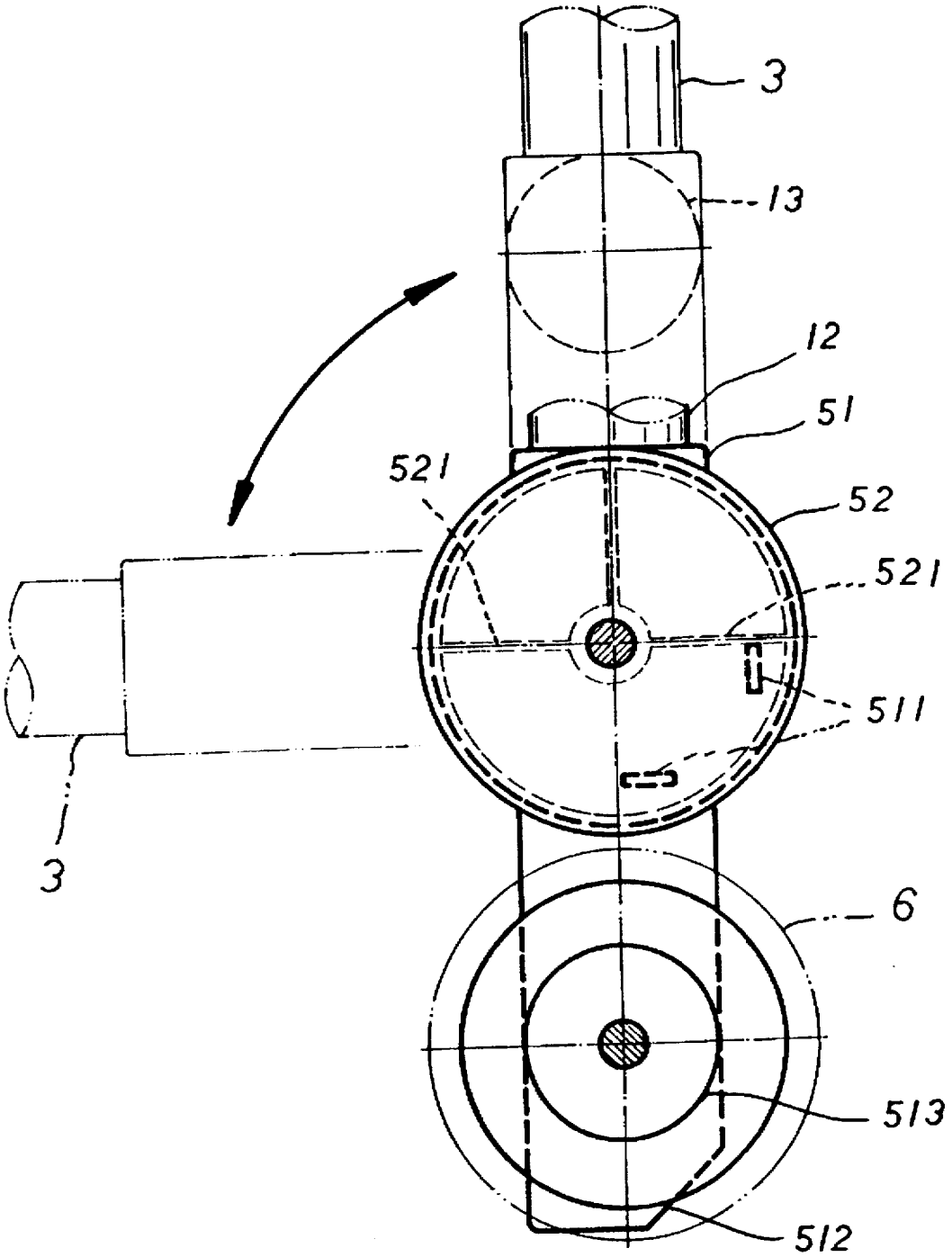
FIG. 7 is a sectional assembly view of FIG. 6, showing the bottom frame rod collapsed.
Figure 9:
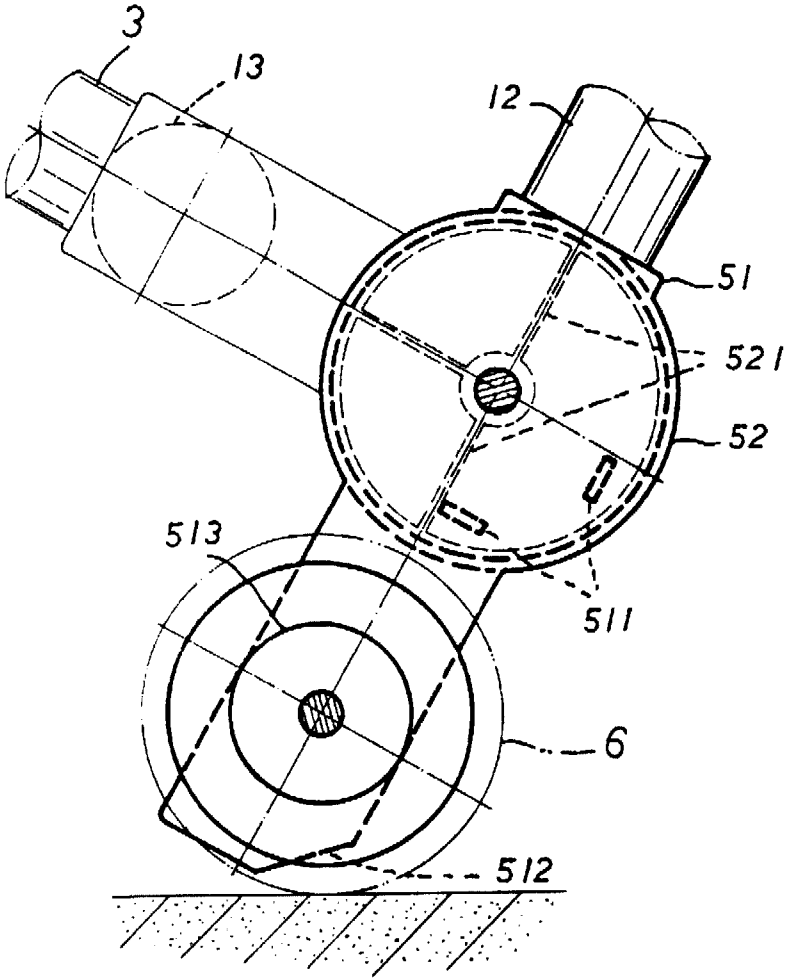
FIG. 9 is similar to FIG. 8 but showing the post tilted.
Figure 8:
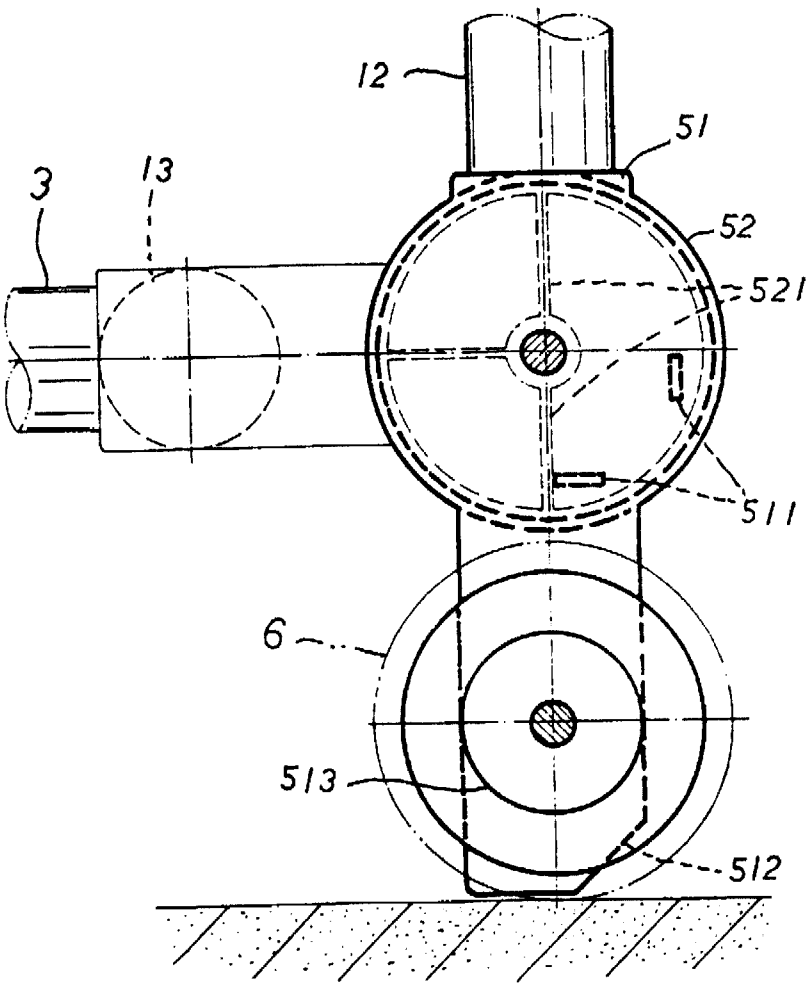
FIG. 8 is similar to FIG. 7 but showing the bottom frame rod turned from the collapsed position to the operative position.

Referring to FIGS. from 6 to 9, the third joint 5 is comprised of a hollow base frame 51 fixedly connected to one post 12, and a hollow swivel frame 52 fixedly connected to between one bottom frame rod 3 and the bottom transverse rod 13 and coupled to the base frame 51 and turned about an axis (see FIG. 6). The swivel frame 52 comprises a straight stop flange 521 on the inside. The base frame 51 comprises two lugs 511 arranged at right angles and acted against the straight stop flange 521 to limit the turning angle of the swivel frame 52 within 90° angle relative to the base frame 51 (see FIG. 7). The base frame 51 further comprises an axle 513 raised from the periphery near the bottom, a wheel 6 mounted on the axle 513 which makes the baby's crib easy to move, and a chamfered bottom edge 512 sloping outwardly upwards in direction reversed to the corresponding bottom frame rod 3. The chambered bottom edge 512 prevents the respective third joint 5 from touching the floor when the baby's crib it tilted (see FIGS. 8 and 9).

Figure 14:
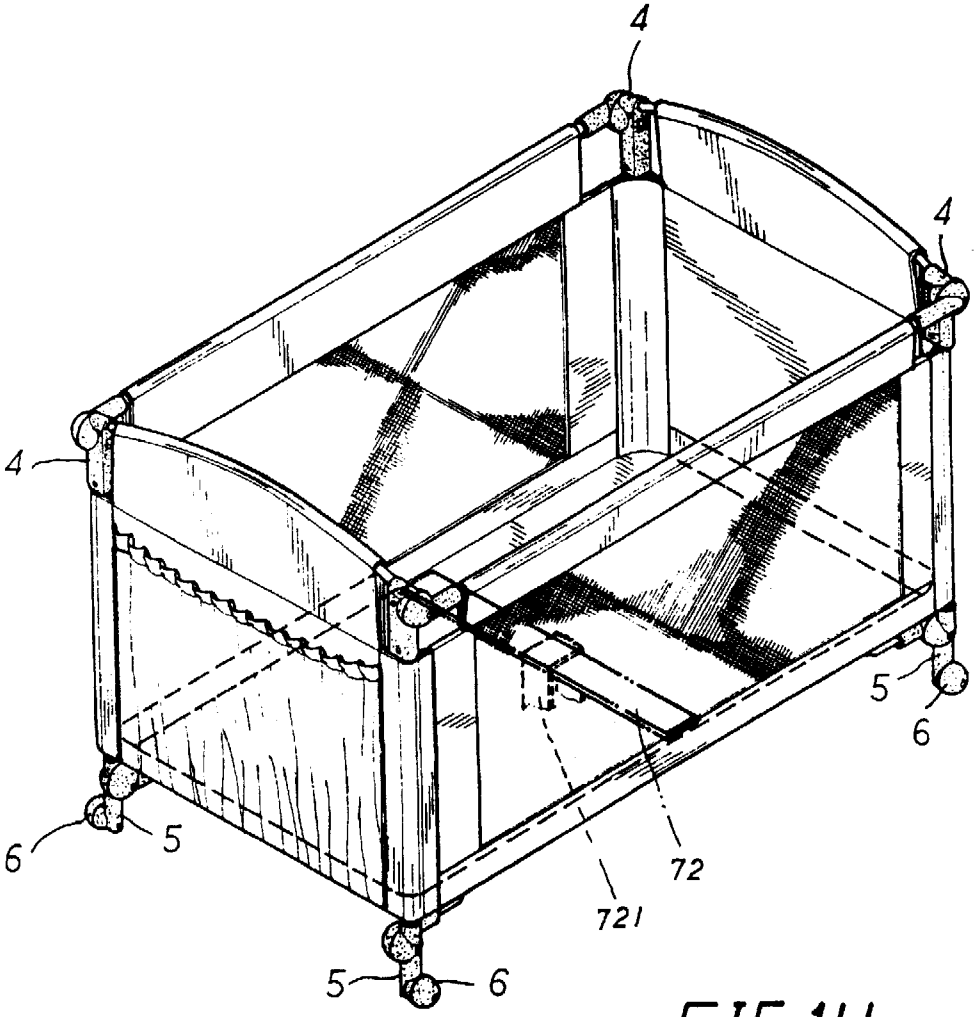
FIG. 14 is a perspective view of a baby's crib according to the present invention when set in the operative condition.
Figure 3:
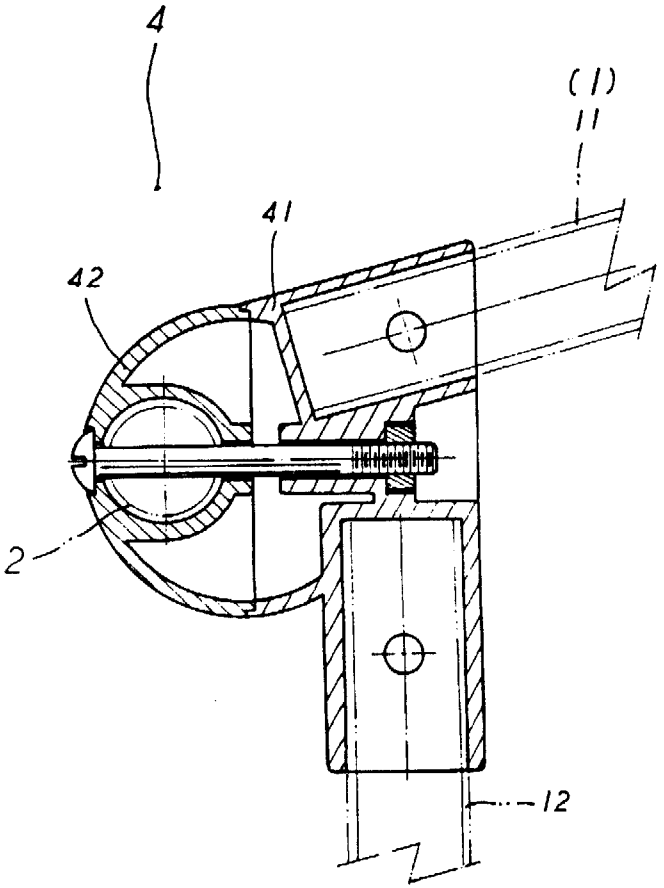
FIG. 3 is a sectional assembly view of FIG. 2.
Figure 15:
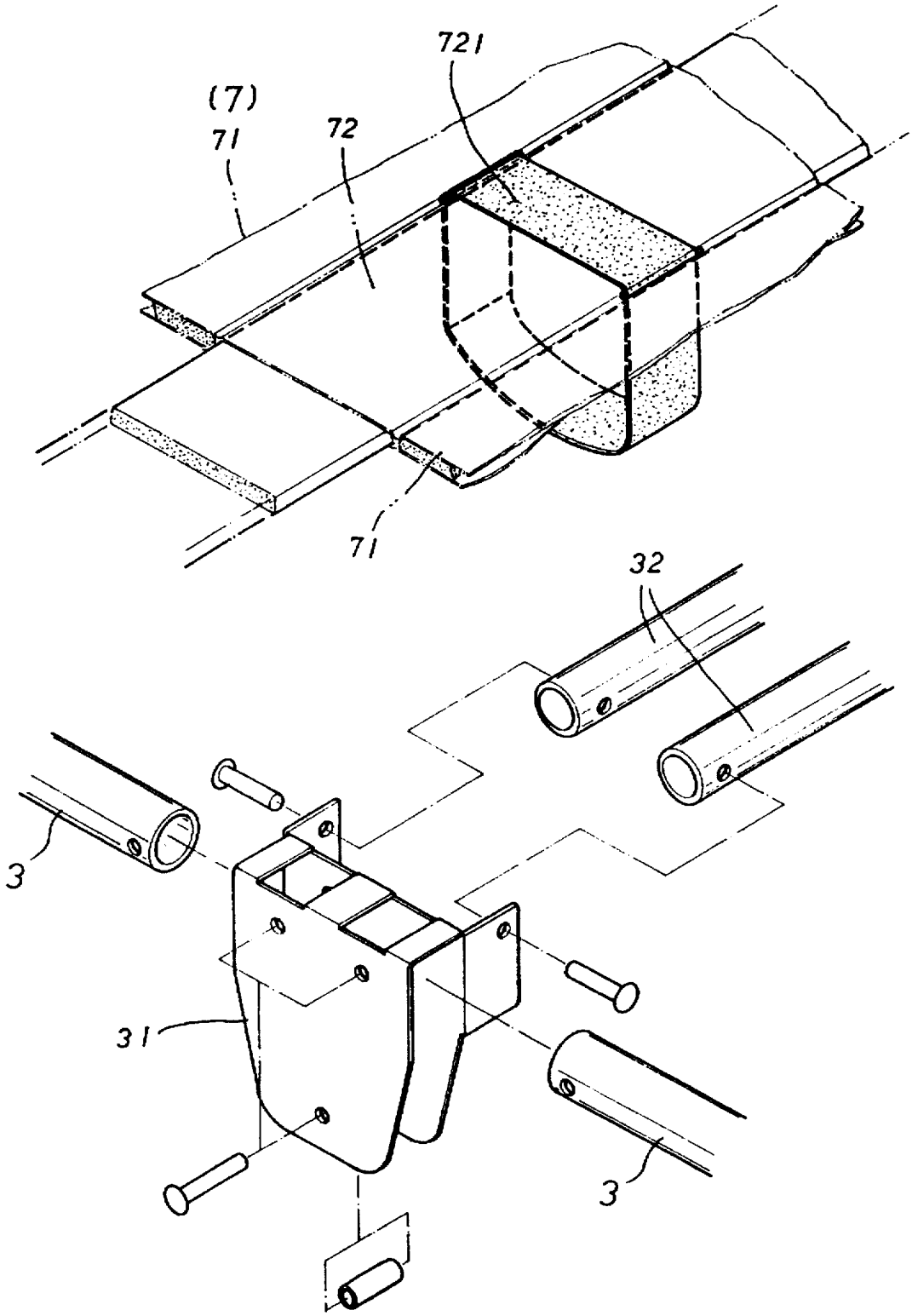
FIG. 15 is a perspective exploded view in an enlarged scale of a part of the present invention, showing the relative relationship between the coupling plate, the bottom frame rod, the stretchers, and the folding bed plate.
Figure 17:
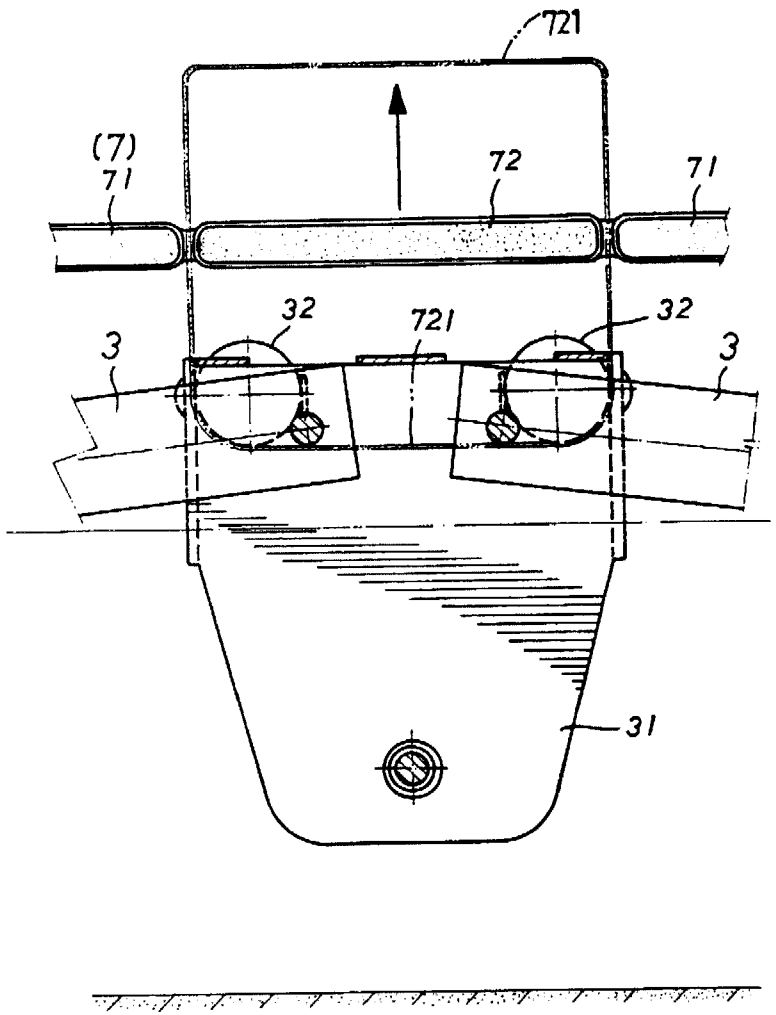
FIG. 17 is similar to FIG. 16 but showing the two sections of the bottom frame rod turned upwards.
Figure 16:
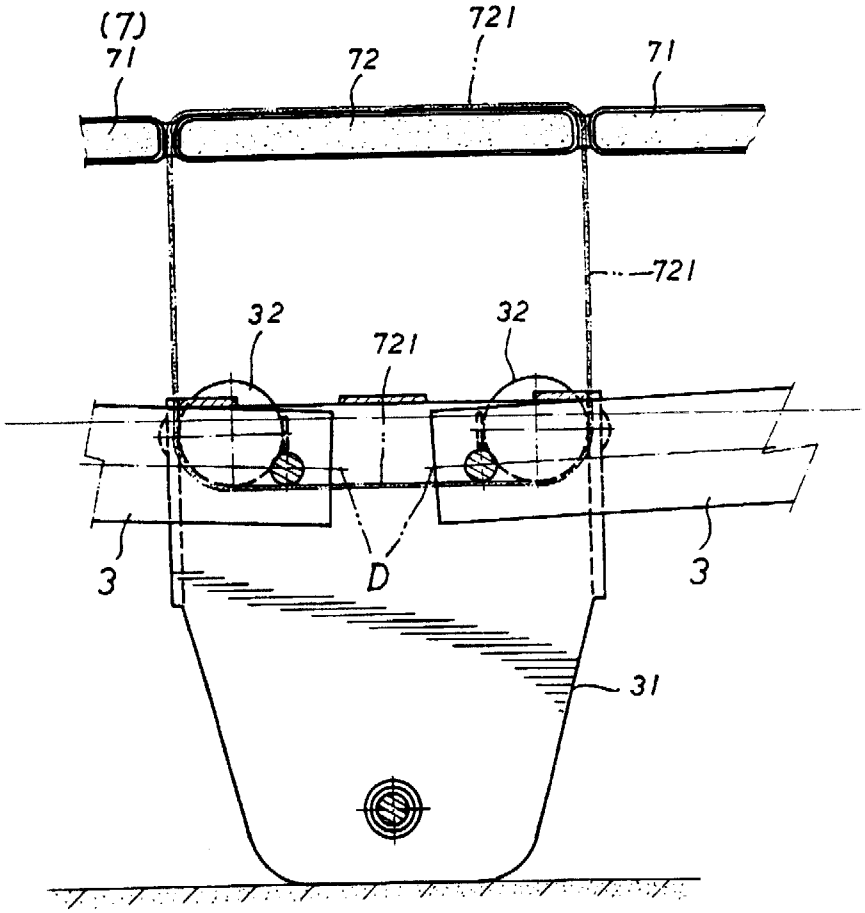
FIG. 16 is a perspective view in an enlarged scale of a part of the present invention, showing the two sections of the bottom frame rod set in the operative position.
Figure 19:
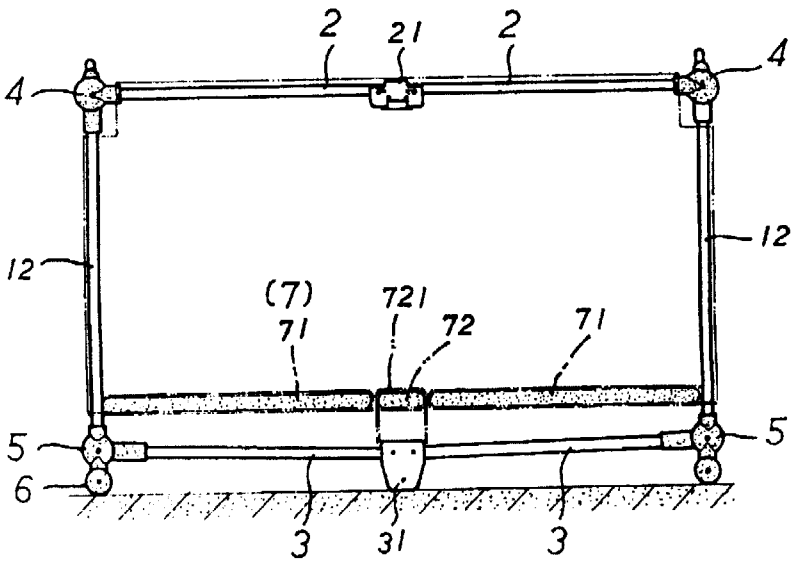
FIG. 19 is a front side view of the present invention, showing the folding collapsible frame structure set in the operative condition.
Figure 18:
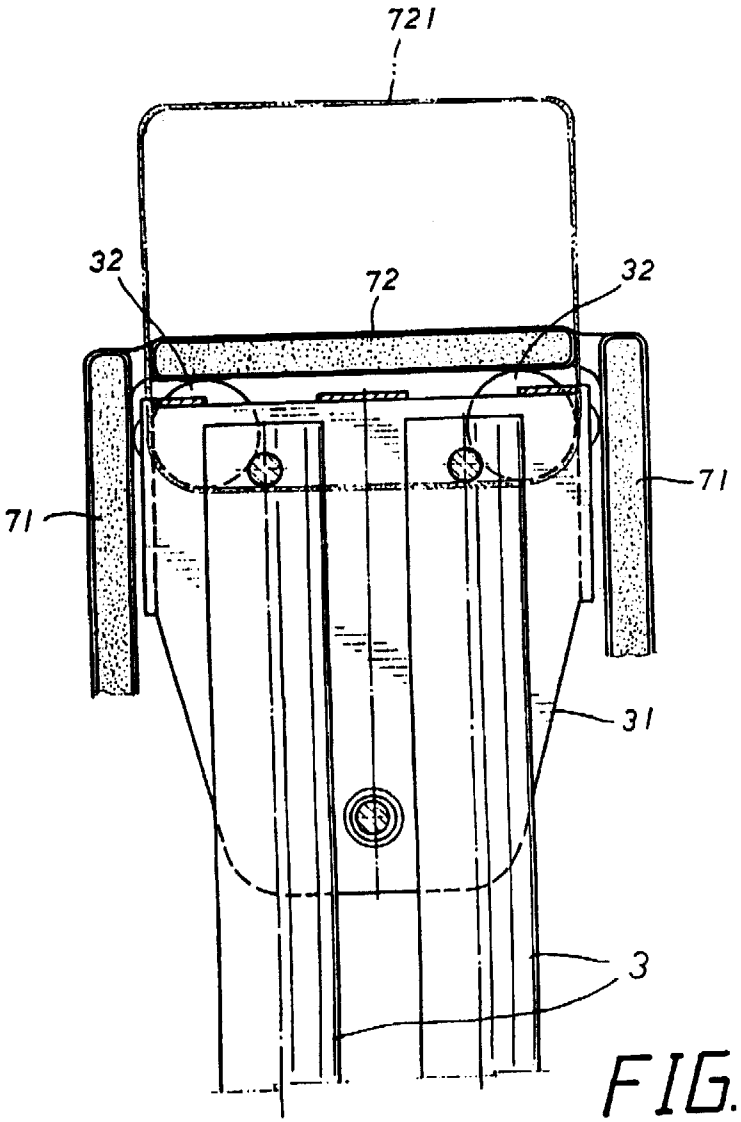
FIG. 18 is similar to FIG. 17 but showing the bottom frame rod and the folding bed plate folded up.
Figure 20:
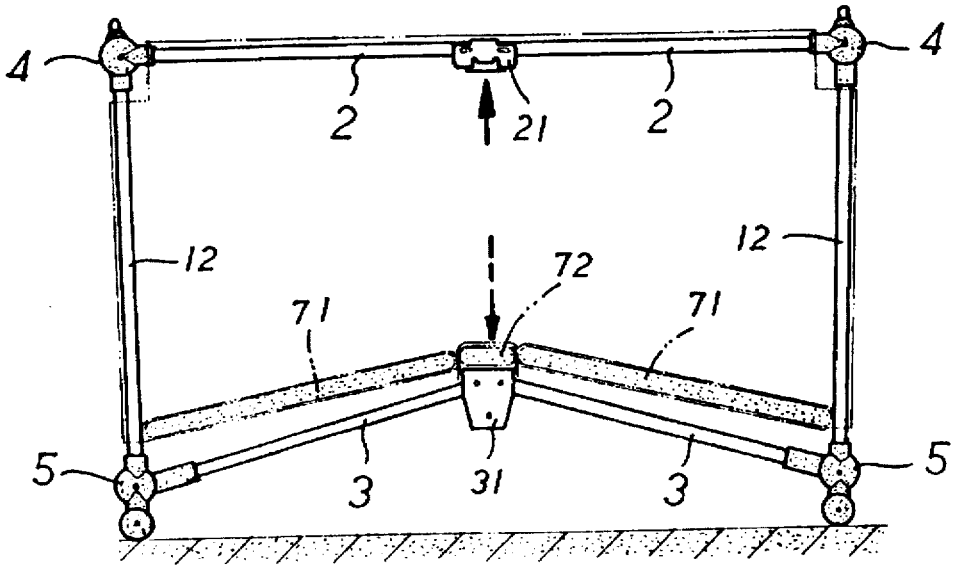
FIG. 20 is another front side view of the present invention, showing the first joint of the top frame rod and the coupling plate of the bottom frame rod respectively pushed in reversed directions.
Figure 21:
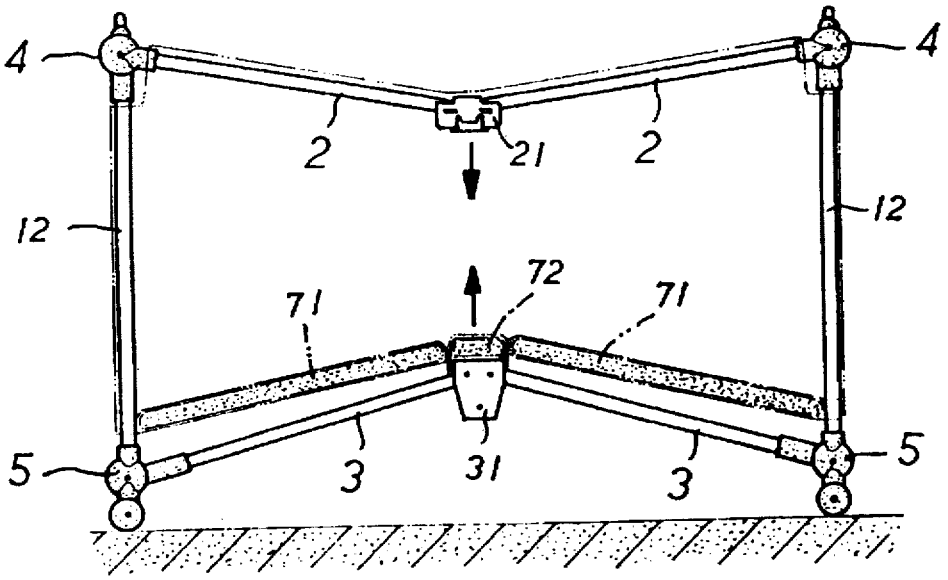
FIG. 21 is another front side view of the present invention, showing the first joint of the top frame rod and the coupling plate of the bottom frame rod respectively moved toward each other.

Referring to FIGS. from 14 to 18, and FIGS. 1 and 10 again, two parallel stretchers 32 are connected between the coupling plates 31 of the bottom frame rods 3. When the bottom frame rods 3 are set into the operative position, the longitudinal central axes D of the two sections of each bottom frame rod 3 are longitudinally aligned at an elevation lower than the horizontal line passing through the center of the parallel stretchers 32 (see FIG. 16), and therefore the bottom frame rods 3 are firmly retained in the, operative position. Further, a folding bed plate 7 is mounted within the baby's crib and supported on the stretchers 32. The bed plate 7 is comprised of a narrow intermediate plate 72, and two side plates 71 bilaterally hinged to the intermediate plate 72 (see FIGS. 14 and 15). The intermediate plate 72 is mounted with fabric loops 721 which are respectively sleeved onto the stretchers 32. By pulling the fabric loops 721 upwards, the stretchers 32 and the coupling plates 31 are lifted, and therefore the bottom frame rods 3 are folded up (see FIGS. 17 and 18).

Figure 11:
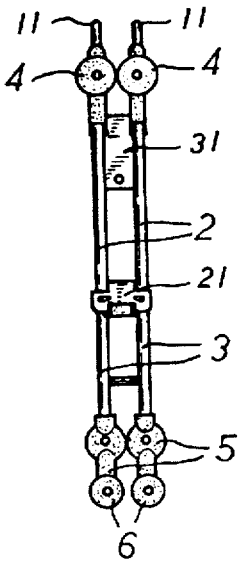
FIG. 11 is a front view of the present invention, showing the folding collapsible frame structure collapsed.
Figure 12:
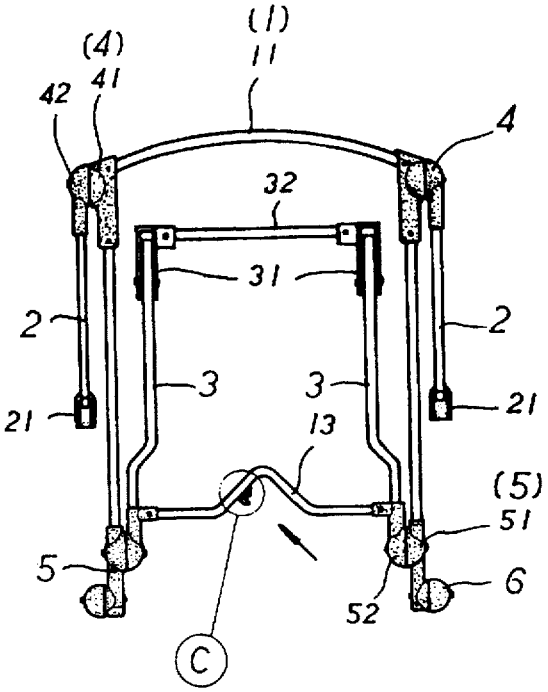
FIG. 12 is a side view of FIG. 11.
Figure 13:
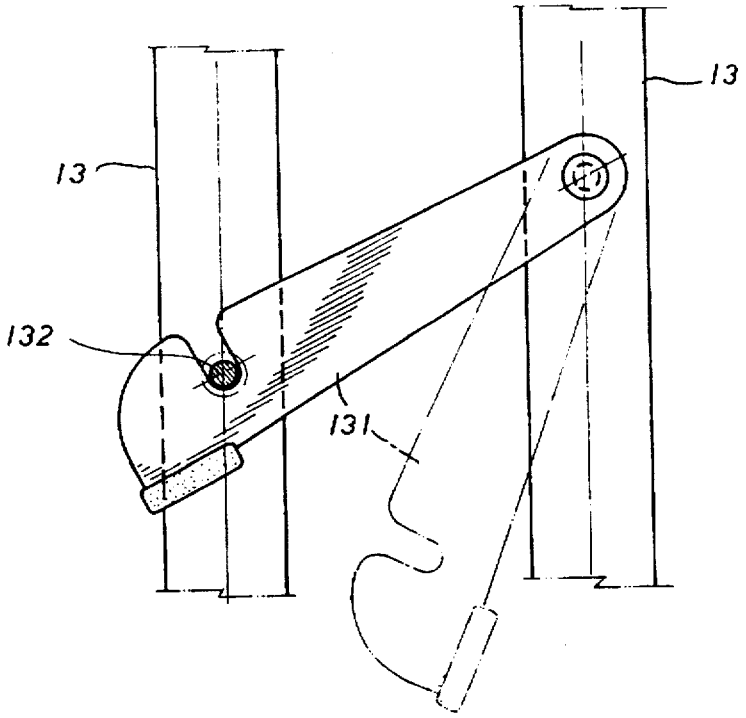
FIG. 13 is an enlarged view of part C of FIG. 12, showing the swivel hook hooked on the locating pin.

Referring to FIGS. from 11 to 13, a swivel hook 131 and a locating pin 132 are respectively mounted on the bottom transverse rods 13 of the side frame units 1 (see FIG. 13). When the frame structure is folded up, the swivel hook 131 is hooked on the locating pin 132 to secure the frame structure in the collapsed condition (see FIGS. 11 and 12).

Referring to FIGS. from 19 to 21, and FIGS. 11 and 12 again, when the fabric loops 721 are pulled upwards and the first joints 21 are controlled to let the two sections of each top frame rod 2 to be turned downwards, the whole frame structure of the baby's crib is folded up and collapsed, and then the swivel hook 131 is hooked on the locating pin 132 to secure the frame structure in the collapsed condition. When to set the frame structure from the collapsed condition to the operative condition, it is simply done by pulling the top frame rods 2 upwards from the folded up condition to the straight condition and pushing the bottom frame rods 2 downwards from the folded up condition to the straight condition.

While only one embodiment of the present invention has been shown and described, it will be understood that various modifications and changes could be made thereunto without departing from the spirit and scope of the invention disclosed.

What the invention claimed is:

1. A folding collapsible frame structure for a baby's crib, comprising:

two symmetrical side frame units vertically disposed at two opposite sides, each of said side frame units comprised of a top transverse rod, a bottom transverse rod, and two posts bilaterally connected between said top transverse rod and said bottom transverse rod;

a pair of top frame rods horizontally and bilaterally connected between said side frame units at the top;

two pairs of top joints respectively and bilaterally connected between said side frame units and said top frame rods, said top joints permitting the two sections of each of said top frame rods to be folded up to pull said side frame units toward each other;

a pair of bottom frame rods horizontally and bilaterally connected between said side frame units at the bottom, each of said bottom frame rods comprised of two sections bilaterally pivoted together by a coupling plate, each of said bottom frame rods comprised of two sections pivoted together;

two pairs of bottom joints respectively and bilaterally connected between said side frame units and said bottom frame rods, said bottom joints permitting the two sections of each of said bottom frame rods to be folded up to pull said side frame units toward each other;

two stretchers connected between the coupling plates of said bottom frame rods;

a folding bed plate supported on said stretchers; and two pairs of wheels respectively and bilaterally mounted on said side frame units at the bottom which make the baby's crib easy to move;

wherein each of said top joints is comprised of a hollow base frame fixedly connected between one top transverse rod and one post, and a hollow swivel frame fixedly connected to one top frame rod and coupled to the base frame of the respective top joint and turned about an axis within 90 angle relative to the base frame of the respective top joint between a horizontal position perpendicular to the corresponding side frame unit, and a vertical position closely attached to the corresponding side frame unit; each of said bottom joints is comprised of a hollow base frame fixedly connected to one post, and a hollow swivel frame fixedly connected to between one bottom frame rod and the bottom transverse rod of the respective side frame unit and coupled to the base frame of the respective bottom joint and turned about an axis within 90° angle relative to the base frame of the corresponding bottom joint between a horizontal position perpendicular to the corresponding side frame unit, and a vertical position closely attached to the corresponding side frame unit.

2. The folding collapsible frame structure of claim 1 wherein the swivel frame of each of said top joints comprises a sector flange at an inner side inserted into the base frame of the corresponding top joint; the base frame of each of said top joints has a horizontal stop flange on the inside adapted to match with the 90° sector flange of the corresponding swivel frame, so as to limit the turning angle of the swivel frame of the corresponding top joint within 90° angle relative to the base frame of the corresponding top joint.

3. The folding collapsible frame structure of claim 1 wherein the swivel frame of each of said bottom joints comprises a straight stop flange on the inside; the base frame of each of said bottom joints comprises two lugs arranged at right angles and acted against the straight stop flange of the corresponding swivel frame to limit the turning angle of the corresponding swivel frame within 90° angle.

4. The folding collapsible frame structure of claim 1 wherein the base frame of each of said bottom joints further comprises an axle raised from the periphery near the bottom which holds one wheel, and a chamfered bottom edge sloping outwardly upwards in direction reversed to the corresponding bottom frame rod.

5. The folding collapsible frame structure of claim 1 wherein said folding bed plate is comprised of a narrow intermediate plate supported on said stretchers, two side plates bilaterally hinged to said intermediate plate and respectively supported on the two sections of said bottom frame rods, and a plurality of loop means respectively mounted on said intermediate plate and sleeved onto said stretchers.

6. The folding collapsible frame structure of claim 1 further comprising a locating pin and a swivel hook respectively mounted on the bottom transverse rods of said side frame units, said swivel hook being hooked on said locating pin to secure the folding frame structure in a collapsed condition when said top frame rods and said bottom frame rods are folded up.

7. The folding collapsible frame structure of claim 1 wherein the longitudinal central axes of the two sections of each of said bottom frame rods are tilted downwardly inwards toward each other at an elevation below the horizontal line passing through said stretchers.

* * * * *